US005590951A

United States Patent [19]

Matthews

[11] Patent Number: 5,590,951

[45] Date of Patent: Jan. 7, 1997

[54] SWITCH-LESS FLASHLIGHTS

[75] Inventor: John W. Matthews, Corona del Mar, Calif.

[73] Assignee: Laser Products Ltd., Fountain Valley, Calif.

[21] Appl. No.: 363,633

[22] Filed: Dec. 21, 1994

[51] Int. Cl.[6] ..... F21L 7/00

[52] U.S. Cl. ..... 362/205; 362/203

[58] Field of Search ..... 362/189, 202, 362/203, 205, 206

[56] References Cited

U.S. PATENT DOCUMENTS

| | | | |
|---|---|---|---|
| Re. 29,047 | 11/1976 | Brindley | 362/205 |
| D. 263,170 | 2/1982 | Maglica | D26/49 |
| D. 297,828 | 9/1988 | Bromley | D13/6 |
| D. 298,748 | 11/1988 | Sharrah | D13/6 |
| D. 303,107 | 8/1989 | Maglica | D13/6 |
| D. 306,492 | 3/1990 | Sharrah | D26/49 |
| D. 307,488 | 4/1990 | Sharrah | D26/49 |
| D. 308,109 | 5/1990 | Maglica | D26/49 |
| D. 310,425 | 9/1990 | Sharrah | D26/49 |
| D. 312,509 | 11/1990 | Sharrah | D26/49 |
| D. 324,430 | 3/1992 | Sharrah | D26/46 |
| 1,403,538 | 1/1922 | Burgess | 362/187 |
| 1,433,570 | 10/1922 | Stimson | 362/187 |
| 1,603,272 | 10/1926 | Eaton | 362/187 |
| 1,661,784 | 3/1928 | Blake | 362/187 |
| 1,669,292 | 5/1928 | Eckstein | 362/188 |
| 1,671,623 | 5/1928 | Barany | 200/60 |
| 1,674,650 | 6/1928 | Leser | 362/188 |
| 1,680,169 | 8/1928 | Osean | 362/188 |
| 1,680,188 | 8/1928 | Weber | 362/205 |
| 1,781,064 | 11/1930 | Jones | 362/187 |
| 1,823,762 | 9/1931 | Rathmann | 362/188 |
| 1,955,511 | 4/1934 | Muros | 362/202 |
| 2,008,915 | 7/1935 | Langos | 362/203 |
| 2,016,819 | 10/1935 | Meginniss | 362/158 |
| 2,020,352 | 11/1935 | Bolduc | 362/205 |
| 2,097,222 | 10/1937 | Tompkins | 362/187 |
| 2,125,038 | 7/1938 | Tompkins et al. | 362/188 |
| 2,164,148 | 6/1939 | Swanson | 362/203 |
| 2,176,084 | 10/1939 | Lennan | 200/302.2 |
| 2,225,936 | 12/1940 | Williams | 362/206 |

(List continued on next page.)

FOREIGN PATENT DOCUMENTS

| | | | |
|---|---|---|---|
| 138873 | 4/1948 | Australia . | |
| 872870 | 6/1942 | France | 362/203 |
| 1271830 | 8/1961 | France . | |
| 1430456 | 1/1966 | France . | |
| 2372382 | 6/1978 | France . | |
| 383112 | 10/1923 | Germany | 362/203 |
| 411218 | 6/1934 | United Kingdom . | |
| 555910 | 9/1943 | United Kingdom . | |
| 586357 | 3/1947 | United Kingdom . | |
| 604807 | 7/1948 | United Kingdom | 362/203 |
| 752619 | 7/1956 | United Kingdom . | |
| 812980 | 5/1959 | United Kingdom . | |
| 884212 | 12/1961 | United Kingdom . | |
| WO94/13022 | 6/1994 | WIPO . | |

*Primary Examiner*—Ira S. Lazarus
*Assistant Examiner*—Alan B. Cariaso
*Attorney, Agent, or Firm*—Benoit Law Corporation

[57] ABSTRACT

Switch-less flashlights have a tube for housing the battery and a lamp assembly threaded or mounted on an end portion of that tube and having spaced first and second lamp terminals adapted to contact corresponding battery terminals upon rotation or movement of that lamp assembly relative to the tube in a first sense of rotation or direction. One of such first and second lamp terminals is also adapted to disengage from a corresponding one of the first and second battery terminals upon rotation or movement of the lamp assembly relative to the tube in a second sense of rotation or direction. The flashlight preferably includes a spring, such as in the form of the first lamp terminal contacting the first battery terminal, for permanently pressing the battery against an opposite end portion of the battery housing tube. A special version of the flashlight has a flexible diaphragm across one end of the tube depressible against the battery so as to activate the flashlight by longitudinal movement of the battery in the flashlight.

34 Claims, 1 Drawing Sheet

U.S. PATENT DOCUMENTS

| | | | |
|---|---|---|---|
| 2,259,106 | 10/1941 | Hager | 200/60 |
| 2,338,078 | 12/1943 | Wood | 362/187 |
| 2,339,356 | 1/1944 | Sachs | 362/187 |
| 2,385,639 | 9/1945 | Packer et al. | 362/196 |
| 2,439,496 | 4/1948 | Szantay | 362/205 |
| 2,461,118 | 2/1949 | Lippincott | 362/205 |
| 2,490,830 | 12/1949 | Norton | 362/205 |
| 2,503,287 | 4/1950 | Moore | 200/60 |
| 2,518,437 | 8/1950 | Amstutz | 362/205 |
| 2,520,023 | 8/1950 | Allen | 362/184 |
| 2,530,913 | 11/1950 | Schakel | 362/205 |
| 2,599,295 | 6/1952 | Thomas | 200/60 |
| 2,769,896 | 11/1956 | Lambert | 362/205 |
| 2,797,309 | 6/1957 | Dulberg | 362/203 |
| 2,830,280 | 4/1958 | Webber | 339/191 |
| 2,852,632 | 9/1958 | Garland | 200/60 |
| 2,852,633 | 9/1958 | Garland | 200/60 |
| 2,876,410 | 3/1959 | Fry | 320/48 |
| 2,897,345 | 7/1959 | Meager et al. | 362/158 |
| 2,915,621 | 12/1959 | Garland | 362/205 |
| 2,931,005 | 3/1960 | Saurwein et al. | 439/660 |
| 2,945,944 | 7/1960 | Gillespie | 362/188 |
| 3,014,125 | 12/1961 | Draudt | 362/205 |
| 3,105,233 | 9/1963 | D'Amore et al. | 362/206 |
| 3,226,538 | 12/1965 | Bustamante | 362/184 |
| 3,250,911 | 5/1966 | Oldenburgrer | 362/183 |
| 3,521,050 | 7/1970 | Shagena, Jr. | 362/183 |
| 3,701,862 | 10/1972 | Vignini | 429/97 |
| 3,717,759 | 2/1973 | Rousseau | 362/186 |
| 3,798,440 | 3/1974 | Brindley | 362/205 |
| 3,825,740 | 7/1974 | Friedman et al. | 362/183 |
| 3,835,272 | 9/1974 | Wisenbaker | 200/60 |
| 3,924,116 | 12/1975 | Brindley | 362/158 |
| 3,924,117 | 12/1975 | Brindley | 362/191 |
| 4,092,580 | 5/1978 | Prinsze | 320/2 |
| 4,135,230 | 1/1979 | Armbruster | 362/206 |
| 4,151,583 | 4/1979 | Miller | 362/205 |
| 4,171,534 | 10/1979 | Strowe | 362/183 |
| 4,203,150 | 5/1980 | Shamlian | 362/183 |
| 4,234,913 | 11/1980 | Ramme | 362/158 |
| 4,244,011 | 1/1981 | Hammel et al. | 362/183 |
| 4,261,026 | 4/1981 | Bolha | 362/101 |
| 4,281,368 | 7/1981 | Humbert | 362/100 |
| 4,286,311 | 8/1981 | Maglica | 362/205 |
| 4,327,401 | 4/1982 | Siiberg | 362/183 |
| 4,329,740 | 5/1982 | Colvin | 362/184 |
| 4,345,304 | 8/1982 | Penney et al. | 362/183 |
| 4,357,648 | 11/1982 | Nelson | 362/183 |
| 4,388,673 | 6/1983 | Maglica | 362/183 |
| 4,398,139 | 8/1983 | Prinsze | 320/2 |
| 4,398,238 | 8/1983 | Nelson | 362/187 |
| 4,429,351 | 1/1984 | Petzl et al. | 362/187 |
| 4,441,142 | 4/1984 | Garofalo | 362/158 |
| 4,463,283 | 7/1984 | Penney et al. | 315/87 |
| 4,472,766 | 9/1984 | Hung | 362/158 |
| 4,495,551 | 1/1985 | Foltz | 362/205 |
| 4,502,102 | 2/1985 | Phipps | 362/183 |
| 4,514,790 | 4/1985 | Will | 362/187 |
| 4,527,223 | 7/1985 | Maglica | 362/187 |
| 4,530,034 | 7/1985 | Kawarada | 362/9 |
| 4,531,178 | 7/1985 | Uke | 362/158 |
| 4,577,263 | 3/1986 | Maglica | 362/187 |
| 4,581,686 | 4/1986 | Nelson | 362/204 |
| 4,605,993 | 8/1986 | Zelina, Jr. | 362/183 |
| 4,640,258 | 3/1987 | Penney et al. | 124/24 |
| 4,656,565 | 4/1987 | Maglica | 362/187 |
| 4,658,336 | 4/1987 | Maglica | 362/197 |
| 4,725,932 | 2/1988 | Gammache | 362/202 |
| 4,733,337 | 3/1988 | Bieberstein | 362/206 |
| 4,760,504 | 7/1988 | Schaller | 362/205 |
| 4,777,582 | 10/1988 | Sharrah | 362/205 |
| 4,788,633 | 11/1988 | Zimermann | 362/296 |
| 4,803,605 | 2/1989 | Schaller | 362/184 |
| 4,819,141 | 4/1989 | Maglica | 362/207 |
| 4,823,242 | 4/1989 | Maglica | 362/187 |
| 4,825,345 | 4/1989 | Stevens | 362/183 |
| 4,841,417 | 6/1989 | Maglica | 362/206 |
| 4,843,298 | 6/1989 | Brauch | 320/2 |
| 4,851,974 | 7/1989 | Maglica | 362/187 |
| 4,864,474 | 9/1989 | Maglica | 362/203 |
| 4,876,416 | 10/1989 | Frantz | 200/11 R |
| 4,885,668 | 12/1989 | Maglica | 362/345 |
| 4,888,670 | 12/1989 | Sharrah | 362/205 |
| 4,899,265 | 2/1990 | Maglica | 362/187 |
| 4,914,555 | 4/1990 | Gammache | 362/183 |
| 4,942,505 | 7/1990 | Maglica | 362/187 |
| 4,956,755 | 9/1990 | Maglica | 362/206 |
| 5,003,440 | 3/1991 | Maglica | 362/158 |
| 5,008,785 | 4/1991 | Maglica | 362/183 |
| 5,113,326 | 5/1992 | Maglica | 362/158 |
| 5,121,308 | 6/1992 | Maglica | 362/187 |
| 5,143,441 | 9/1992 | Maglica | 362/263 |
| 5,158,358 | 10/1992 | Maglica | 362/206 |
| 5,161,095 | 11/1992 | Gammache | 362/197 |
| 5,171,086 | 12/1992 | Baloochi | 362/188 |
| 5,317,490 | 5/1994 | Miller | 362/206 |

SWITCH-LESS FLASHLIGHTS

FIELD OF THE INVENTION

The subject invention relates to battery-powered apparatus and, more specifically, to flashlights.

OBJECT OF THE INVENTION

It is a broad object of the invention to provide improved flashlights.

It is also an object of the invention to obviate a need for the conventional type of "on-off" switches, such as sliding switches, in flashlights.

It is also an object of the invention to improve the retention of batteries in flashlights against rattling and instability.

It is also an object of the invention to guard the lamp assembly and lamp in flashlights against mechanical shocks.

It is also an object of the invention to concentrate the delivery of electric power from a battery in a flashlight to the lamp assembly area.

It is a related object of the invention to avoid a need to conduct electric power from an end of the battery through a part of the flashlight outside of the battery.

It is an alternative object of the invention to improve rear-end switching of flashlights.

It is a related object of the invention to improve rear-end switching of flashlights without an electric rear-end switch.

Other objects will become apparent in the further course of this disclosure.

SUMMARY OF THE INVENTION

The subject invention relates to a switch-less flashlight using a battery having two opposite ends and having spaced first and second battery terminals on one of these ends, comprising, in combination, a tube for housing the battery, and a lamp assembly threaded or mounted on an end portion of that tube and having spaced first and second lamp terminals adapted to contact the first and second battery terminals upon rotation or movement of that lamp assembly relative to the tube in a first sense of rotation or direction. One of such first and second lamp terminals includes a spring and is also adapted to disengage from a corresponding one of the first and second battery terminals upon rotation or movement of the lamp assembly relative to the tube in a second sense of rotation or direction.

The subject invention relates also to a switch-less flashlight using a battery having spaced first and second battery terminals which comprises, in combination, a tube for housing the battery and a lamp assembly threaded or mounted on an end portion of that tube and having spaced first and second lamp terminals. That first lamp terminal includes a first spring contacting the first battery terminal and permanently pressing the battery against an opposite end portion of the battery housing tube, and the second lamp terminal includes a second spring and is adapted to contact the second battery terminal upon rotation or movement of the threaded lamp assembly relative to that tube in a first sense of rotation or direction. The second lamp terminal is also adapted to disengage from the second battery terminal upon rotation or movement of the threaded lamp assembly relative to the tube in a second sense of rotation or direction.

The subject invention further relates to a switch-less flashlight using a battery having two opposite ends and having spaced first and second battery terminals on one of these ends, which comprises, in combination, a tube for housing the battery, a flexible diaphragm across one end of the tube depressible against the battery in the tube which is adapted to permit longitudinal movement of the battery in that tube upon movement of the flexible diaphragm, and a lamp assembly threaded or mounted on an opposite end of that tube and having spaced first and second lamp terminals adapted to contact the first and second battery terminals upon rotation of the threaded lamp assembly relative to that tube, and a first spring pressing the battery toward said one end of the tube. One of the spaced first and second lamp terminals includes a second spring and is also adapted to be disengaged by a corresponding one of the first and second battery terminals upon relaxation of the flexible diaphragm at the one end of the tube and return movement of the battery in the tube.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

The accompanying drawings constitute a written description of embodiments of the invention and also illustrate switch-less flashlights 10 and 100 according to preferred embodiments of the invention. While flashlights according to the invention may be switched "on" and "off," the subject invention and its preferred embodiments obviate a need for the conventional "on-off" switches present in conventional flashlights, and are "switch-less" in that sense. In particular, there is no need for the well-known manually engageable push buttons or manually engageable slide actuators typical with conventional flashlights.

Figure 1:
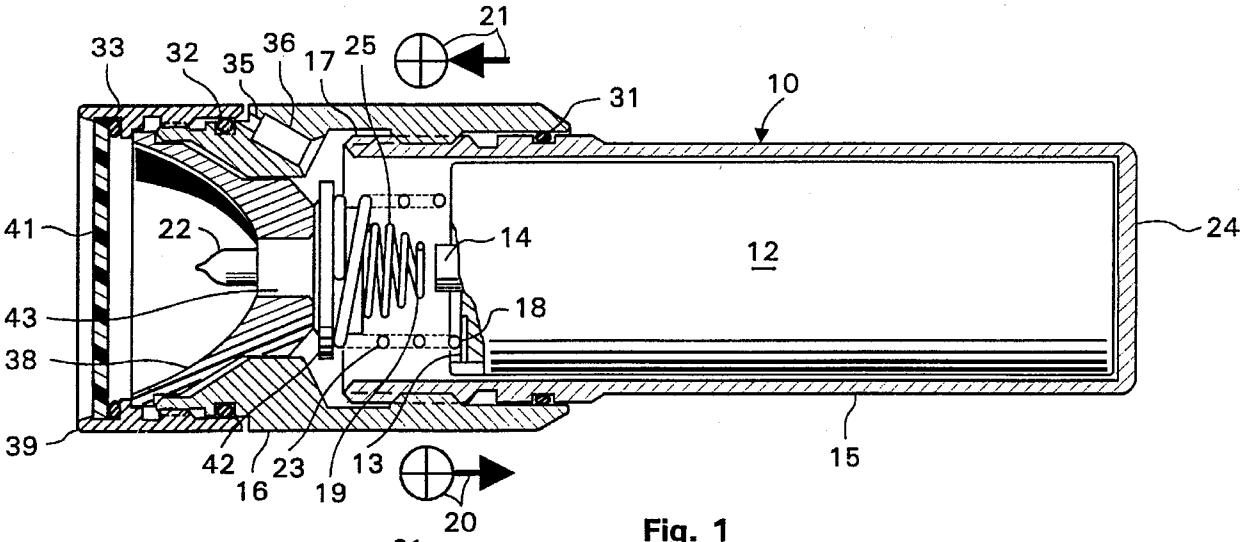
FIG. 1 is a longitudinal section through a flashlight according to a first embodiment of the invention.
Figure 2:
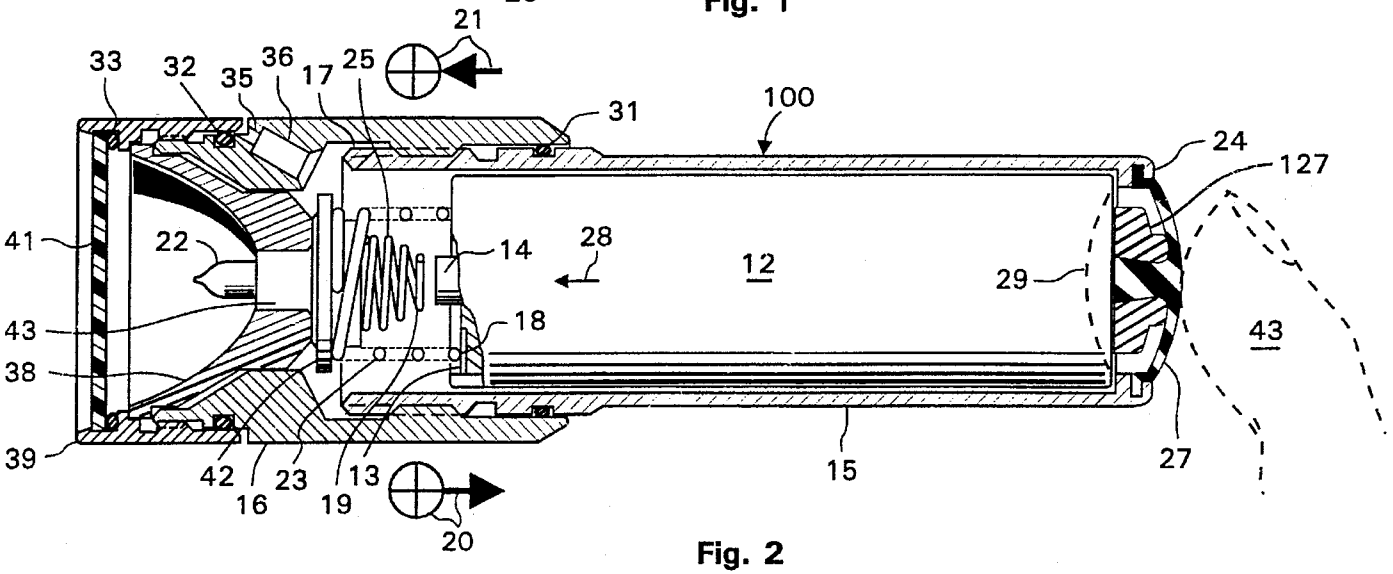
FIG. 2 is a longitudinal section through a flashlight according to a second embodiment of the invention.

Flashlights according to the invention comprise or use a battery 12 having spaced first and second battery terminals 13 and 14, such as shown in FIGS. 1 and 2. The battery 12 has opposite front and rear ends, and has the first and second battery terminals 13 and 14 on its front end so as to avoid a need to conduct electric power from an end of the battery through a part of the flashlight outside of the battery. In the illustrated embodiments, no electric power is conducted through the battery housing or tube 15, and no electric conductor is extended in between the battery and its housing outside of the battery as in prior-art flashlights.

The expression "battery" may refer to a single cell and to an assembly of two or more cells having a common terminal 13, in addition to the opposite terminal 14.

The illustrated flashlights 10 and 100 comprise a tube 15 for housing the battery 12 and a lamp assembly 16 threaded on an end portion 17 of that tube. Within the scope of the invention, the lamp assembly 16 may be mounted on the battery barrel tube 15 by means other than threading. For instance, the lamp assembly may be mounted slidable on the front end 17 of the tube 15. In that case, corresponding catches or detents may be provided on the tube 15 and lamp assembly 16 at 17 to releasably retain the lamp assembly either in the extended or "lamp off" position shown in FIGS. 1 end 2 with a gap existing between the battery terminal 14 and lamp terminal 19, or in the contracted or "lamp on" position in which the battery terminal 14 and the lamp terminal 19 contact each other.

The lamp assembly 16 has spaced first and second lamp terminals 18 and 19 adapted to contact the first and second battery terminals 13 and 14 upon rotation of that threaded lamp assembly 16 relative to the tube 15 in a first sense of rotation, signified in FIGS. 1 and 2 by a first rotary symbol 20 that may, for instance, signify clockwise rotation as seen from the left-hand side in Figs. 1 and 2. Alternatively, the first and second lamp terminals 18 and 19 contact the first and second battery terminals 13 and 14 upon movement of the lamp assembly 16 relative to the tube 15 in a first direction signified in FIGS. 1 and 2 by a first arrow at the rotary symbol 20.

One of the first and second lamp terminals, such as the terminal 19, is also adapted to disengage from a corresponding one of the first and second battery terminals such as from the terminal 14, upon rotation of the threaded lamp assembly 17 relative to the tube 15 in a second or opposite sense of rotation, signified in FIGS. 1 and 2 by a countervailing rotary symbol 21. Alternatively, the one of the first and second lamp terminals, such as the terminal 19, disengages from a corresponding one of the first and second battery terminals, such as from the terminal 14, upon movement of the lamp assembly 16 relative to the tube 15 in a second or opposite direction signified in FIGS. 1 and 2 by a countervailing arrow at the second rotary symbol 21.

The flashlight 10 or 100 may thus by energized by rotating or moving the battery housing tube 15 and lamp assembly 16 relative to each other, such as indicated at 20, so that the gap between the battery terminal 14 and lamp terminal 19 closes, which energizes an electric light bulb or lamp 22 by an electric current or electrical energy from the battery 12, thereby lighting the flashlight 10 or 100.

Conversely, the lamp 22 is deenergized and unnecessary drain of electrical energy from the battery 12 is avoided by an opposite rotation or movement 21 of the battery housing tube 15 and the lamp assembly 16 relative to each other, so that the gap between the battery terminal 14 and lamp terminal 19 is restored.

In the preferred embodiments seen in FIGS. 1 and 2, the other of the first and second lamp terminals, such as the terminal 18, contact the corresponding other of the first and second battery terminals, such as the terminal 13, before rotation or movement of the lamp assembly in the first sense of rotation or direction 20, as well as after rotation or movement of such lamp assembly 16 in the second sense of rotation or direction 21.

Rattling and instability of the battery 12 in its housing 15 are precluded by a spring 23 that presses the battery against an opposite end portion 24 of the tube 15. By way of example, the other of the first and second lamp terminals, such as the terminal 18, may include a spring 23 contacting the corresponding other of the first and second battery terminals, such as the terminal 13, before rotation or movement of the lamp assembly in the first sense of rotation or direction 20, as well as after rotation or movement of such lamp assembly 16 in the second sense of rotation or direction 21. In particular, the spring 23 in effect is the lamp terminal 18 pressing the battery 12 toward the opposite end 24 of the battery housing or tube 15.

The first and second battery terminals 13 and 14 preferably are on the same side of the battery 12, such as on the end of the battery facing the lamp assembly 16. By way of example, the first and second battery terminals 13 and 14 are concentric. The first and second lamp terminals 18 and 19 preferably are also concentric, and may be formed or constituted by concentric springs 23 and 25 corresponding to the first and second battery terminals 13 and 14.

The springs 23 and 25 may act like shock-absorbers, guarding the lamp 22 against shock loads and against impact from a shifting battery.

A preferred embodiment of the invention thus resides in a switch-less flashlight 10 or 100 using a battery 12 having spaced first and second battery terminals 13 and 14, comprising, in combination, a tube 15 for housing the battery, and a lamp assembly 16 threaded on an end portion 17 of such tube and having spaced first and second lamp terminals 18 and 19. Such first lamp terminal 18 preferably includes a first spring 23 contacting the first battery terminal 13 and permanently pressing the battery 12 against an opposite end portion 24 of the tube 15. The second lamp terminal 19 preferably includes a second spring 25 adapted to contact the second battery terminal 14 upon rotation or movement of the lamp assembly 16 relative to the single tube 15 in a first sense of rotation or direction 20. Such second spring 25 is also adapted to disengage from the second battery terminal 14 upon rotation or movement of the lamp assembly 16 relative to the tube 15 in a second sense of rotation or direction 21, such as shown in FIGS. 1 and 2.

The first and second battery terminals 13 and 14 and the first and second springs 23 and 25 preferably are concentric. As seen in FIGS. 1 and 2, the first spring 23 preferably is longer than the second spring 25 in an axial or longitudinal direction of the tube 15 or lamp assembly 16. Put otherwise, the second spring or terminal 25 preferably is shorter than the first spring 23, in that axial or longitudinal direction.

The embodiment of the invention shown in FIGS. 2 also has a tube 15 for housing the battery 12, but includes a flexible diaphragm 27 across one end 24 of such tube depressible against the battery 12 in the tube. In the illustrated embodiment, the diaphragm 27 is supplemented and extends through a disc or washer 127. However, the reference numeral 27 is used to refer to such compound diaphragm, if used.

The tube 15 is adapted to permit longitudinal movement of the battery in such tube upon movement of the flexible diaphragm 27, such as indicated at 29.

The lamp assembly 16 on an opposite end 17 of the tube 15 has spaced first and second lamp terminals 18 and 19 adapted for contact by the first and second battery terminals 13 and 14 on the one end of the battery, where the battery terminals 13 and 14 are located, upon depression of the flexible diaphragm and longitudinal movement of the battery in the tube. Spring 23 presses the battery 12 toward the end 24 of tube 15 where the diaphragm is located.

As seen in FIG. 2, one of the spaced first and second lamp terminals, such as the terminal 19, is also adapted to be disengaged by a corresponding one of the first and second battery terminals, such as battery terminal 14, upon relaxation of the flexible diaphragm 27 at the one end of the tube 15 and return movement of the battery 12 in the tube 15.

Within the scope of the invention, the flexible diaphragm light switching feature may be combined with the other switching feature that operates upon rotation or movement of the lamp assembly relative to the tube 15, such as disclosed above.

The flashlight 100 may thus be switched "on" and "off" in the same manner as the flashlight 10, such as described above. In addition or alternatively, the flashlight 100 may be switched "on" and "off" be depression of the end diaphragm 27, such as by a human finger or thumb 43, and by a subsequent withdrawal of such finger and relaxation of the diaphragm 27, respectively.

The invention according to the embodiment of FIG. 2 improves rear-end switching of flashlights without an electric rear-end switch. According to the aspect of the invention shown in FIGS. 1 and 2, the delivery of electric power from the battery 12 in the flashlight to the lamp 22 is concentrated at the lamp assembly area. Unlike standard prior-art practice, there need to be no electrical lead or connection from the end 24 of the battery barrel or tube 15 to the lamp assembly area 16 or 42.

Unlike some prior-art electrically conductive switching diaphragms, the depressible diaphragm 27 according to an embodiment of the invention is and remains electrically insulated from the battery 12 prior to and during operation of the flashlight 100. By way of example, the depressible diaphragm 27 is an elastomeric diaphragm across the one end 24 of the tube 15.

Pursuant to a preferred embodiment of invention the diaphragm switching feature and the lamp assembly switching feature may be combined with each other, such as shown in FIG. 2. For instance, the tube 15 and lamp assembly 16 may be rotated or otherwise moved relative to each other until the lamp 22 is at the point of being lit, except for the existence of a small gap between battery terminal 14 and lamp assembly terminal 19. The lamp or flashlight may then be lit by a relatively small depression of the flexible diaphragm 27, such as by a thumb or finger 43.

In practice, the travel 29 of the diaphragm 27 required for actuation of the flashlight, or the "touch" of the flashlight so to speak, is then easily adjusted for different persons and preferences by preliminary rotary or other motion 20 or 21 of the lamp assembly 16 relative to the barrel 15.

According to a preferred embodiment of the invention, the depressible diaphragm 27 is threadlessly connected to that one end 24 of the tube 15. This may render the flashlight 100 substantially as watertight as the closed-bottom flashlight 10 as in FIG. 1.

Further water-tightness may be assured by various 0-rings 31, 32, 33.

In practice, this without more could inhibit a venting of gases from the battery 12. Accordingly, each flashlight 10 or 100 has a battery gas vent aperture.

Pursuant to an embodiment of the invention, a battery gas vent aperture 35 is in the lamp assembly 16, such as shown in FIGS. 1 and 2.

According to an embodiment of the invention, the flashlight 10 or 100 includes a battery gas vent plug 36, which preferably extends through said lamp assembly 16.

Various plastic and other porous materials may be used for the vent plug, to make sure that gas can go out of the flashlight 10 or 100 without water getting in.

The lamp assembly 16 may include a lamp reflector 38 releasably retained by a threaded bezel 39. A plastic disc or other transparent lens or member 41 protects the bulb 22 and reflector 38.

The bulb 22 preferably includes an incandescent filament (not shown) connected between lamp terminals 18 and 19 or springs 23 and 25 for energization through battery terminals 13 and 14.

The springs 23 and 25 may be held in a piece of ceramic or other electrically insulating material or retainer 42 which may also mount the lamp socket 43.

The flashlight 10 or 100 is very handy and is immune to the kind of wear, tear and defect that affects prior-art flashlights equipped with conventional "on-off" sliding and other switches.

The flashlight 100 can be clenched in a person's fist, with the person's fingers extending around part of the circumference of the tube 15 and the person's thumb 43 being then in a position to activate the flashlight by depression of the end diaphragm 27, such as indicated by arrow 28 and inwardly bent diaphragm portion 29.

In this manner, the user can forcefully hold and activate the flashlight. For instance, the user can hold the flashlight with clenched fingers at a side of his or her head and can then activate the flashlight with his or her thumb so that it shines into the dark ahead of his or her head without blinding his or her eyes. A user thus can shine the flashlight forcefully and effectively into an attacker's eyes, stunning him and prompting him to go elsewhere.

By way of further example, a user can walk with the flashlight 10 or 100 clenched in his or her fingers and with the light beam pointing downwardly to illuminate his or her path. In the case of the flashlight 100, the user can easily activate and deactivate the light beamwith his or her thumb while walking. Moreover, a driver or passenger in an automobile or other vehicle can use the flashlight in the position just mentioned to find locations on a road map or along the road, or to illuminate road signs or house numbers.

Moreover, a person can hold the flashlight backward, such in the web between thumb and index finger or between index and middle finger and can then actuate the flashlight with, say, the middle finger or the thumb at the diaphragm 27. In this manner, the user can shine the light behind his or her person, so as to discourage people that follow him or her too closely.

Furthermore, the user can hold the flashlight 10 or 100 in the palm of one hand and can activate and deactivate the flashlight with the thumb and index finger engaging and rotating or otherwise moving the lamp assembly 16 relative to the barrel or tube 15, such as shown at 20 or 21 in FIG. 1 or 2.

This extensive disclosure will render apparent or suggest to those skilled in the art various modifications and variations within the spirit and scope of the invention.

I claim:

1. A switch-less flashlight using a battery having two opposite ends and having spaced first and second battery terminals on one of said ends, comprising in combination:

a tube for housing said battery; and a lamp assembly mounted on an end portion of said tube and having spaced first and second lamp terminals adapted to contact said first and second battery terminals on said one end of the battery upon movement of said mounted lamp assembly relative to said tube in a first direction;

one of said first and second lamp terminals including a spring and being also adapted to disengage from a corresponding one of said first and second battery terminals upon movement of said mounted lamp assembly relative to said tube in a second direction.

2. A flashlight as in claim 1, including:

the other of said first and second lamp terminals contacting the corresponding other of said first and second battery terminals before movement of said mounted lamp assembly in said first direction, as well as after movement of said mounted lamp assembly in said second direction.

3. A flashlight as in claim 1, including:

a further spring pressing the battery against an opposite end portion of said tube.

4. A flashlight as in claim 1, wherein:

the other of said first and second lamp terminals includes a further spring contacting the corresponding other of said first and second battery terminals before movement of said mounted lamp assembly in said first direction, as well as after movement of said mounted lamp assembly in said second direction.

5. A flashlight as in claim 1, wherein:

said first and second battery terminals and said first and second lamp terminals are concentric.

6. A flashlight as in claim 1, wherein;

said first and second battery terminals are concentric; and said first and second lamp terminals are concentric springs corresponding to said first and second battery terminals.

7. A flashlight as in claim 1, wherein:

said lamp assembly is threaded on the end portion of said tube and has said spaced first and second lamp terminals adapted to contact said first and second battery terminals upon rotation of said threaded lamp assembly relative to said tube in a first sense of rotation;

one of said first and second lamp terminals also adapted to disengage from a corresponding one of said first and second battery terminals upon rotation of said threaded lamp assembly relative to said tube in a second sense of rotation.

8. A flashlight as in claim 1, including:

a housing including said tube and said lamp assembly; and a battery gas vent aperture in said housing.

9. A flashlight as in claim 1, including:

a battery gas vent aperture in said lamp assembly.

10. A flashlight as in claim 1, including:

a housing including said tube and said lamp assembly; and a battery gas vent plug in said housing.

11. A flashlight as in claim 1, including:

a battery gas vent plug extending through said lamp assembly.

12. A switch-less flashlight using a battery having spaced first and second battery terminals, comprising in combination:

a tube for housing said battery; and a lamp assembly on an end portion of said tube and having spaced first and second lamp terminals;

said first lamp terminal including a first spring contacting the first battery terminal and permanently pressing the battery against an opposite end portion of said tube; and said second lamp terminal including a second spring adapted to contact the second battery terminal upon movement of said lamp assembly relative to said tube in a first direction;

said second lamp terminal also adapted to disengage from said second battery terminal upon movement of said lamp assembly relative to said tube in a second direction.

13. A flashlight as in claim 12, wherein:

said first and second battery terminals and said first spring and said second spring are concentric.

14. A flashlight as in claim 12, wherein:

said second spring is shorter than said first spring in an axial direction of said tube.

15. A flashlight as in claim 12, wherein:

said lamp assembly is threaded on an end portion of said tube;

the second spring adapted to contact the second battery terminal upon rotation of said threaded lamp assembly relative to said tube in a first sense of rotation; and said second spring also adapted to disengage from said second battery terminal upon rotation of said threaded lamp assembly relative to said tube in a second sense of rotation.

16. A flashlight as in claim 12, including:

a housing including said tube and said lamp assembly; and a battery gas vent aperture in said housing.

17. A flashlight as in claim 12, including:

a battery gas vent aperture in said lamp assembly.

18. A flashlight as in claim 12, including:

a housing including said tube and said lamp assembly; and a battery gas vent plug in said housing.

19. A flashlight as in claim 12, including:

a battery gas vent plug extending through said lamp assembly.

20. A switch-less flashlight using a battery having two opposite ends and having spaced first and second battery terminals on one of said ends, comprising in combination:

a tube for housing said battery;

a flexible diaphragm across one end of said tube depressible against said battery in said tube;

said tube adapted to permit longitudinal movement of said battery in said tube upon movement of said flexible diaphragm; and a lamp assembly on an opposite end of said tube and having spaced first and second lamp terminals adapted for contact by said first and second battery terminals on said one end of the battery upon depression of said flexible diaphragm and longitudinal movement of said battery in said tube;

a first spring pressing the battery toward said one end of said tube;

one of said spaced first and second lamp terminals including a second spring and being also adapted to be disengaged by a corresponding one of said first and second battery terminals upon relaxation of said flexible diaphragm at said one end of the tube and return movement of said battery in said tube.

21. A flashlight as in claim 20, wherein:

said flexible diaphragm is and remains electrically insulated from said battery prior to and during operation of said flashlight.

22. A flashlight as in claim 20, wherein:

said flexible diaphragm is an elastomeric diaphragm across said one end of the tube.

23. A flashlight as in claim 20, wherein:

said flexible diaphragm is threadlessly connected to said one end of the tube.

24. A flashlight as in claim 20, wherein:

said first and second battery terminals and said first and second lamp terminals are concentric.

25. A flashlight as in claim 20, wherein:

said first spring is said first lamp terminal pressing the battery toward said one end of said tube.

26. A flashlight as in claim 20, wherein:

said first and second battery terminals are concentric; and said first and second lamp terminals are concentric springs corresponding to said first and second battery terminals.

27. A flashlight as in claim 20, wherein:

said lamp assembly is moveable relative to an opposite end of said tube and has said spaced first and second lamp terminals adapted to contact said first and second battery terminals upon movement of said mounted lamp assembly relative to said tube.

28. A flashlight as in claim 27, including:

one of said first and second lamp terminals contacting a corresponding one of said first and second battery terminals before and after movement of said mounted lamp assembly relative to said tube, as well as before and after said depression of said diaphragm.

29. A flashlight as in claim 27, including:

one of said first and second lamp terminals adapted to disengage from a corresponding one of said first and second battery terminals upon movement of said mounted lamp assembly opposite to said movement relative to said tube.

30. A flashlight as in claim 20, wherein:

said lamp assembly is threaded on an opposite end of said tube and has said spaced first and second lamp terminals adapted to contact said first and second battery terminals upon rotation of said threaded lamp assembly relative to said tube.

31. A flashlight as in claim 20, including:

a housing including said tube and said lamp assembly; and a battery gas vent aperture in said housing.

32. A flashlight as in claim 20, including:

a battery gas vent aperture in said lamp assembly.

33. A flashlight as in claim 20, including:

a housing including said tube and said lamp assembly; and a battery gas vent plug in said housing.

34. A flashlight as in claim 20, including:

a battery gas vent plug extending through said lamp assembly.

* * * * *